US007568776B2

(12) United States Patent
Ito et al.

(10) Patent No.: US 7,568,776 B2
(45) Date of Patent: Aug. 4, 2009

(54) RECORDING APPARATUS

(75) Inventors: Hirosumi Ito, Nagoya (JP); Tomoyuki Kubo, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 282 days.

(21) Appl. No.: 11/364,164

(22) Filed: Mar. 1, 2006

(65) Prior Publication Data

US 2006/0197790 A1 Sep. 7, 2006

(30) Foreign Application Priority Data

Mar. 1, 2005 (JP) ..... 2005-056390
Mar. 1, 2005 (JP) ..... 2005-056391
Mar. 8, 2005 (JP) ..... 2005-063319

(51) Int. Cl.
*B41J 29/38* (2006.01)

(52) U.S. Cl. ..... 347/10; 347/9; 347/11; 347/12; 347/13; 347/15; 347/55; 347/56; 347/57

(58) Field of Classification Search ..... 347/9–13, 347/15, 55–57
See application file for complete search history.

(56) References Cited

U.S. PATENT DOCUMENTS 5,305,024 A 4/1994 Moriguchi et al.
5,975,667 A 11/1999 Moriguchi et al.

FOREIGN PATENT DOCUMENTS

JP 2857445 11/1998
JP 2000158643 6/2000

OTHER PUBLICATIONS

Translation of JP 2000-158643 A.*
Translation of JP 2000-158643 A. JP 2000-158643 A, is dated Jun. 13, 2000.*

* cited by examiner

*Primary Examiner*—Lamson D. Nguyen
*Assistant Examiner*—Justin Seo
(74) *Attorney, Agent, or Firm*—Baker Botts L.L.P.

(57) ABSTRACT

A serial signal for generating a plurality of recording waveform signals is transmitted serially from a signal transmission circuit to a head river. A serial-parallel converting circuit parallely converts the serial signal and generates a plurality of kinds of the recording waveform signals. A selector in the head driver selects a predetermined recording waveform signal from the plurality of kinds of the recording waveform signals based on a selection signal corresponding to each of actuators. The drive pulse of the selected recording waveform signal is outputted to a recording head and carries out dot recording.

6 Claims, 12 Drawing Sheets

[MEMORY WRITE]
BEFORE PRINTING

[MEMORY READ]
ON PRINTING

RECORDING APPARATUS

CROSS-REFERENCE TO RELATED APPLICATIONS

This non-provisional application claims priority under 35 U.S.C. §119(a) on Patent Application No. 2005-056390 filed in Japan on Mar. 1, 2005, Patent Application No. 2005-056391 filed in Japan on Mar. 1, 2005 and Patent Application No. 2005-063319 filed in Japan on Mar. 8, 2005, the entire contents of which are hereby incorporated by reference.

BACKGROUND

The present invention relates to a recording apparatus such as an ink jet recording apparatus.

Conventionally, as a recording apparatus, such ink jet recording apparatuses have been known that record by ejecting ink droplets to a recording medium while moving an ink jet head mounted on a carriage at a predetermined interval along the recording medium.

One example of such ink jet recording apparatuses is provided with a head driver (drive circuit), into which a recording signal (printing signal) and various control signals are inputted from a signal transmission circuit (of a main body of the apparatus), mounted in an ink jet head (hereinafter called as a recording head), and has the head driver drive the recording head provided with ink jet nozzles of a plurality of channels (for example, see Japanese Patent Application Laid-Open No. 2000-158643).

SUMMARY

With the above-mentioned conventional recording head, a recording waveform signal is inputted into the drive circuit in order to drive the recording head, and it becomes necessary, in some cases, to prepare a plurality of recording waveforms, for tone recording, with which different sets of volume of ink droplets are ejected, or to modify a recording waveform, in order to suppress a power peak or avoid a cross-talk, by a block of nozzles or by a line of nozzles. In addition, there is a demand, when performing color printing, for applying the most appropriate recording waveform for the property of an ink of the color, because the property of ink varies according to the colors. In such cases, the type of recording waveform to be used increases in number. As the number of the type of recording waveform increases, in turn, the number of signal lines for inputting the recording waveform into the drive circuit increases.

When the number of signal lines increases in this way, it is not only troublesome, but makes the wiring complicated when using flexible flat cables for transmitting a signal from a signal transmission circuit of the main body of the apparatus to the drive circuit of the recording head, because the width of flexible flat cables becomes wider. In addition, it is also disadvantageous in terms of cost and maintenance.

In view of the above problem, Japanese Patent Application Laid-Open No. 2000-158643 proposes a technology in which a waveform generation circuit is mounted on the recording head to reduce the number of signal lines for inputting the recording waveform signal into the drive circuit of the recording head from the signal transmission circuit of the main body of the apparatus. In other words, such data required for generating a recording waveform as pulse width is serially transferred to the waveform generation circuit mounted on the recording head in advance, and then the recording waveform signal is outputted from the waveform generation circuit based on the data upon start of the recording.

However, with the technology disclosed in Japanese Patent Application Laid-Open No. 2000-158643, although the number of signal lines for inputting the recording waveform signal into the drive circuit of the recording head from the signal transmission circuit of the main body of the apparatus is reduced, the waveform generation circuit is additionally required. Moreover, it is necessary to provide the waveform generation circuit for each type of recording waveform, which increases the weight of the recording head.

Thus, the present invention provides a recording apparatus which can transmit a serial signal for generating a plurality of recording waveform signals from a signal transmission circuit (of a main body of the apparatus) to a drive circuit (of a recording head) by signal lines which are less number than the number of the type of recording waveform without mounting a waveform generation circuit on the recording head.

A recording apparatus according to a first aspect is a recording apparatus comprising: a recording head that performs dot recording and has a plurality of actuators; a drive circuit that outputs drive pulses to the plurality of actuators of the recording head; and a signal transmission circuit that serially transmits, to the drive circuit, a serial signal for generating a plurality of kinds of recording waveform signals for the dot recording, and selection data on a selection signal for selecting, for each actuator, from the plurality of kinds of recording waveform signals, wherein the drive circuit includes: a serial-parallel converting circuit that parallel converts the serial signal transmitted from the signal transmission circuit so as to generate the plurality of kinds of recording waveform signals; and a selecting unit that selects, based on the selection signal, a predetermined recording waveform signal from the plurality of kinds of the recording waveform signals, and the drive circuit outputs the recording waveform signal selected by the selecting unit.

According to the recording apparatus of the first aspect, the serial signal for generating a plurality of kinds of recording waveform signals is transmitted serially from the signal transmission circuit to the drive circuit. Further, the serial signal is parallel converted in the drive circuit to the plurality of kinds of recording waveform signals by the serial-parallel converting circuit. A predetermined recording waveform signal is selected from the parallel-converted plurality of kinds of recording waveform signals, by the selecting unit based on a selection signal and outputted. Then, the drive pulse of the selected recording waveform signal is outputted from the drive circuit to each of the actuators of the recording head and dot recording (printing) is carried out.

Consequently, since the serial signal for generating the plurality of kinds of recording waveform signals is serially transmitted and parallel-converted to generate the plurality of kinds of recording waveform signals, it can be realized that the serial signal for the plurality of kinds of recording waveform signals is transmitted from the signal transmission circuit to the drive circuit by the signal lines which are less number than the number of the type of recording waveform without mounting the waveform generation circuit on a recording head as a conventional procedure. Further, the recording waveform signal can be selected by the selection signal from the plurality of kinds of recording waveform signals, for each of the actuators.

Therefore, for example, when the plurality of kinds of recording waveforms are prepared for tone recording and the recording waveform is required to be changed depending on ink property in case of color printing, the number of recording waveforms is large; therefore it is effective in particular.

A recording apparatus according to a second aspect is a recording apparatus comprising: a recording head that performs dot recording and has a plurality of actuators; a drive circuit that outputs drive pulses to the plurality of actuators of the recording head; and a signal transmission circuit that serially transmits, the drive circuit, serial signals for generating a plurality of kinds of recording waveform signals for the dot recording, and selection data on a selection signal for each actuator, wherein the drive circuit includes: a serial-parallel converting circuit which converts the serial signal, transmitted from the signal transmission circuit, corresponding to a rising edge and a falling edge of each of clock pulses of a clock signal transmitted from the signal transmission circuit, into parallel signals, respectively; a switching circuit that switches both of the parallel signals based on a rising edge and a falling edge of a latching signal transmitted from the signal transmission circuit, and outputs the switched signals as the plurality of kinds of the recording waveform signals; and a selecting unit that selects a predetermined recording waveform signal from the plurality of kinds of the recording waveform signals based on the selection signal, and the drive circuit outputs the recording waveform signal selected by the selecting unit.

According to the recording apparatus of the second aspect, the serial signal for generating a plurality of kinds of recording waveform signals is transmitted serially from the signal transmission circuit, the serial signal is converted to parallel signals, corresponding to the rising edge and falling edge of each clock pulse in clock signals transmitted from the signal transmission circuit, in the serial-parallel converting circuit (of the drive circuit). Further, each of the parallel signals is switched by a switching circuit based on the rising edge and falling edge of a latching signal transmitted from the signal transmission circuit and is outputted as the plurality of kinds of recording waveform signals. In other words, the recording apparatus according to the second aspect can transmit the serial signal from a signal transmission circuit (of a main body of the apparatus) to a drive circuit (of the recording head) by using not only the rising edge of the clock pulse but also the falling edge of the clock pulse with the signal lines which are less number than the number of the type of recording waveform, without mounting the waveform generation circuit on the recording head, even if time for converting the recording waveform signals (namely, time between the displacement points of the recording waveform signals) is shorter than time for serially transmitting a group of the serial signals.

A recording apparatus according to a third aspect is a recording apparatus comprising: a recording head that performs dot recording and has a plurality of actuators; a drive circuit that outputs drive pulses to the plurality of actuators of the recording head; and a signal transmission circuit that serially transmits, to the drive circuit, a serial signal for generating a plurality of recording waveform signals for the dot recording, and selection data on a selection signal for each actuator, wherein the drive circuit includes: a memory device that parallel converts the serial signal transmitted from the signal transmission circuit so as to generate and record therein the plurality of kinds of recording waveform signals for one recording cycle; and a selecting unit that selects, based on the selection signal, a predetermined recording waveform signal from the plurality of kinds of the recording waveform signals stored in the memory device, and the drive circuit outputs the drive pulse of the recording waveform signal selected by the selecting unit.

According to the recording apparatus of the third aspect, the serial signal for generating a plurality of kinds of recording waveform signals is transmitted serially from the signal transmission circuit to the drive circuit. Further, the serial signal is parallel-converted in the memory device of the drive circuit and the plurality of kinds of recording waveform signals for one recording cycle are generated to be stored. A predetermined recording waveform signal is selected from the plurality of kinds of recording waveform signals stored in the memory device, by the selecting unit based on a selection signal and outputted. Then, the drive pulse of the selected recording waveform signal is outputted from the drive circuit to each of the actuators of the recording head and dot recording (printing) is carried out.

Consequently, since the serial signal is serially transmitted and the plurality of kinds of recording waveform signals for one recording cycle are stored in the memory device of the drive circuit, it can be realized that the serial signal is transmitted from the signal transmission circuit to the drive circuit by the signal lines which are less number than the number of the type of recording waveform. Further, the plurality of kinds of recording waveform signals for one recording cycle are stored in the memory device of the drive circuit, they can be utilized when the selecting unit selects the recording waveform signal and it becomes unnecessary to transmit the serial signal serially by every recording cycle; therefore the high speed of the recording can be corresponded.

The above and further objects and features will more fully be apparent from the following detailed description with accompanying drawings.

DETAILED DESCRIPTION OF THE EXEMPLARY EMBODIMENTS

The following illustrates a first embodiment with reference to the drawings. The recording apparatus according to the first embodiment is a well-known ink jet recording apparatus having a recording head mounted on a carriage that reciprocally moves along a recording medium, and ejecting ink droplets on the recording medium from the recording head.

Figure 1:
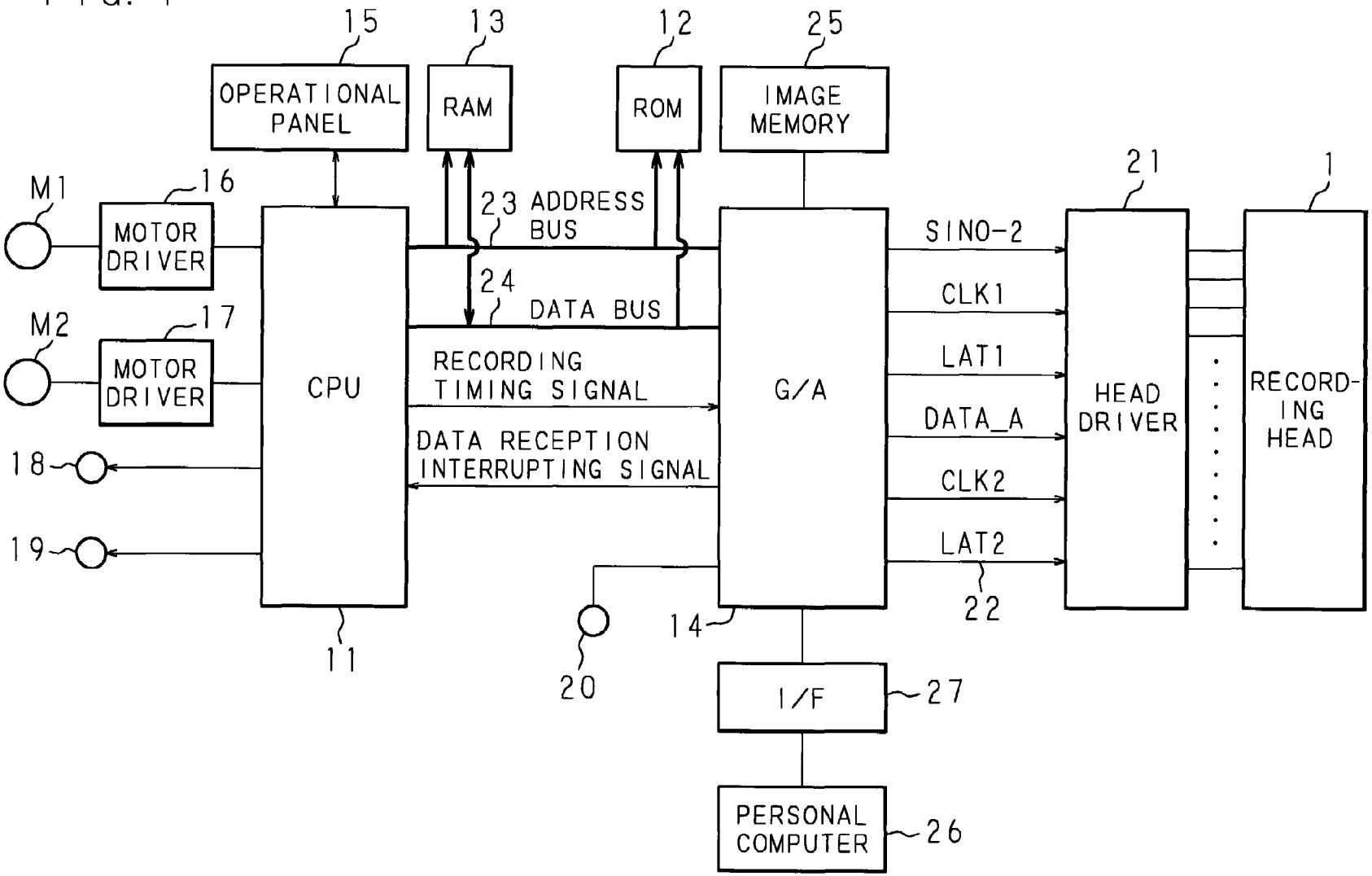
FIG. 1 is a block diagram illustrating an electrical composition of a control device controlling an ink jet recording apparatus according to a first embodiment.

FIG. 1 is a block diagram illustrating an electrical composition of a control device controlling the ink jet recording apparatus according to the first embodiment.

As shown in FIG. 1, the control device (of the ink jet recording apparatus) is provided with a signal transmission circuit that includes a CPU 11 that controls processing of recording signal (printing signal) and an operation of the recording apparatus, a ROM 12 in which a program performed by the CPU 11 is stored, a RAM 13 that temporary stores data when the CPU 11 processes the data, and a gate array 14 which is a gate circuit LSI. Connected to the CPU 11 are an operational panel 15 by which a user instructs printing and such, a motor driver 16 for driving a carriage motor M1 (for reciprocally moving a carriage not illustrated), a motor driver 17 for driving a paper feed motor M2 (for feeding recording paper as a recording medium toward a predetermined direction), a paper sensor 18 that detects an edge of the recording paper, and an origin sensor 19 that detects the position of the origin of the carriage (not illustrated) on which the recording head 1 is mounted.

The recording head 1 is driven by a head driver 21 as the drive circuit. The head driver 21 is mounted on the carriage together with the recording head 1. Further, the head driver 21 is connected with the gate array 14 through a flexible flat cable 22 (harness cable), and the head driver 21 is controlled by the gate array 14.

The recording head 1, though not specifically illustrated, ejects the ink droplets from nozzles by increasing and decreasing volumes of individual ink chambers that respectively contain a plurality of types of ink, by driving actuators including a piezoelectric element, an electrostriction element, and the like. Electrodes for driving the actuators are provided for respective nozzles, and connected with the head driver 21. Based on control of the gate array 14, the head driver 21 generates a drive pulse having a recording waveform appropriate for the recording head 1 and applies the generated drive pulse to each electrode. An encoder sensor 20 that detects a position of the carriage is connected with the gate array 14.

The CPU 11 is connected with the ROM 12, the RAM 13 and the gate array 14 through an address bus 23 and a data bus 24. The CPU 11, in accordance with the program stored in the ROM 12 in advance, generates a recording timing signal and a reset signal, and transmits the signals to the gate array 14. A serial signal for generating a plurality of recording waveform signals described later is stored in the ROM 12 in advance, or stored in the RAM 13 or an image memory 25 after transmitted together with the recording signal from a host computer 26 through an interface 27, and outputted to the gate array 14 during the recording operation.

The gate array 14 temporary stores, in the image memory 25, image data transmitted from the host computer 26 (personal computer) as an external instrument through the interface 27. Further, the gate array 14 generates data reception interrupting signal based on the recording signal transmitted from the host computer 26 through the interface 27, and transmits the data reception interrupting signal to the CPU 11. Then, the gate array 14 generates a clock signal CLK1 and a latching signal LAT1 in accordance with the recording timing signal and the control signal that is transmitted from the encoder sensor 20, and transmits drive signals SIN0-2 (selection data) for forming image data on the recording paper based on the image data temporary stored in the image memory 25 to the head driver 21 synchronously with the clock signal CLK1. Further, the gate array 14 generates a clock signal CLK2 having a cycle different from that of the clock signal CLK1 and a latching signal LAT2 having a cycle different from that of the latching signal LAT1, in accordance with the recording timing signal and the control signal that is transmitted from the encoder sensor 20, and transmits a serial signal DATA_A for generating the plurality of recording waveform signals to the head driver 21 synchronously with the clock signal CLK2. The transmission of the signals from the gate array 14 to the head driver 21 is carried out through the flexible flat cable 22 connecting the head driver 21 with the gate array 14.

Figure 2:
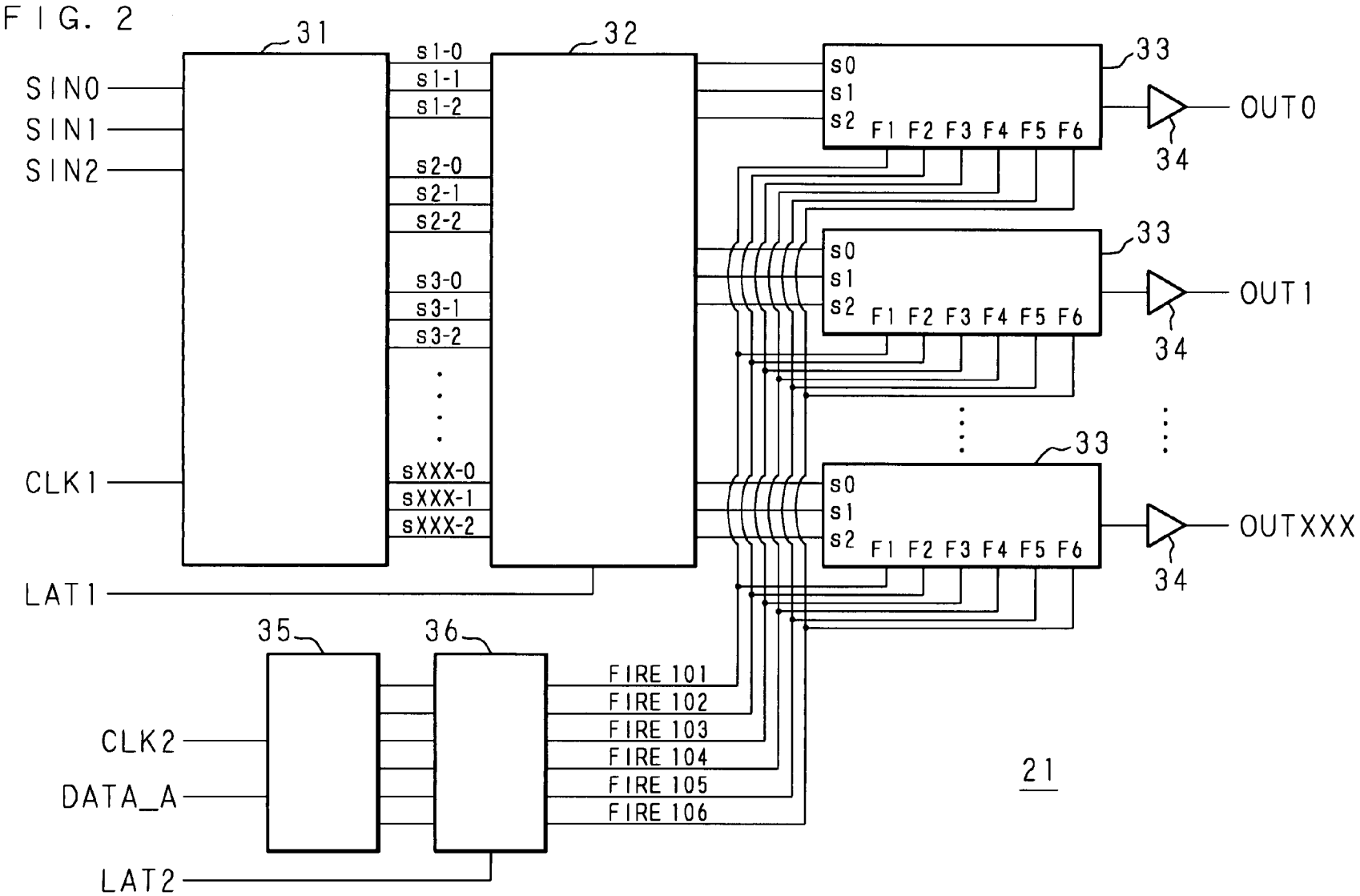
FIG. 2 is a block diagram illustrating a head driver according to the first embodiment.

Further, as shown in FIG. 2, the head driver 21 is provided with a first serial-parallel converting circuit 31 for converting the drive signals SIN0-2 in serial-parallel into signals corresponding to respective actuators, a first latching circuit 32, selectors 33 (selecting unit), drivers 34, a second serial-parallel converting circuit 35 for converting the serial signal in serial-parallel to a plurality of kinds of recording waveform signals and a second latching circuit 36.

When the recording head 1 is a 64 channels multi-nozzle head provided with 64 ink chambers, for example, the first serial-parallel converting circuit 31 is constituted from a shift resistor with 64 bits length. Inputted into the first serial-parallel converting circuit 31 are the drive signals serially transmitted from the gate array 14 synchronously with the clock signal CLK1. The first serial-parallel converting circuit 31 performs the serial-parallel conversion of the drive signals by converting the drive signals into parallel signals in accordance with a rising edge of a clock pulse of the clock signal, and sets selection signals s0, s1 and s2 for each channel. Each of the drive signals is constituted from 3 bits selection signals, and configured to select, according to a combination of bits, a recording waveform signal from the plurality of kinds of recording waveform signals including non printing.

The first latching circuit 32 latches each parallel signal in accordance with the rising edge (of pulse) of the latching signal LAT1 transmitted from the gate array 14.

On the other hand, the second serial-parallel converting circuit 35 is constituted from a shift resistor with 6 bits length corresponding to the number of kinds of recording waveforms. The serial signal DATA_A for generating the plurality of kinds of recording waveform signals which is serially transmitted from the gate array 14 synchronously with the clock signal CLK2 is inputted in the second serial-parallel converting circuit 35, and the serial-parallel conversion of the serial signal is carried out by parallel-converting the serial signal to six kinds of recording waveform signals FIRE 101-106 based on the rising edge of the clock pulse of the clock signal CLK2. Then, the second latching circuit 36 latches the six kinds of the recording waveform signals FIRE 101-106 (parallel signal), respectively, in accordance with the rising edge (of pulse) of the latching signal LAT2 transmitted from the gate array 14. Further, not only the rising edge of the clock pulse of the clock signal but also the falling edge of the clock pulse may be adopted.

Each of 64 selectors 33 provided for each channel selects one from the plurality of kinds of the recording waveform signals FIRE 101-106 which are parallel outputted from the second latching circuit 36 based on parallel drive signals (including the selection signal) which are outputted from the first latching circuit 32, and output the selected one to the drivers 34.

For example, when six kinds of recording waveform signals respectively having different pulse numbers are prepared, a plurality of the recording waveform signals are always outputted repeatedly at a constant cycle. Further, the drive signal includes three selection signals, s0, s1 and s2, and each selector 33 selects one of the recording waveform signals (including non printing) in accordance with the input of the selection signals. Specifically, when the selection signals, s0, s1 and s2 are 0, 0, 0, respectively, the non printing is selected. When the selection signals are 0, 1, 0, the recording waveform signal FIRE 101 is selected. When the selection signals are 0, 0, 1, the recording waveform signal FIRE 102 is selected. When the selection signals are 1, 0, 0, the recording waveform signal FIRE 103 is selected. Thus, 7 tones including non printing can be obtained for each nozzle.

Each of the drivers 34 generates a drive pulse of voltage suitable for the recording head 1 based on one of the recording waveform signals FIRE 101-106 outputted from the corresponding selector 33, and outputs the drive pulse of the selected recording waveform signal to the electrode of the corresponding ink chamber of the recording head 1.

Further, when the recording head 1 does not have 64 channels, the above configuration can be similarly adapted by setting the bit length of the first serial-parallel converting circuit 31, the number of selectors 33, and the number of drivers 34 to be the same as the number of the channels of the recording head 1.

Further, when the number of the kinds of the recording waveform signals is not six, the above configuration can be similarly adapted by setting the bit length of the second serial-parallel converting circuit 35 to the same number as the number of the kinds of the recording waveform signals.

Figure 3:
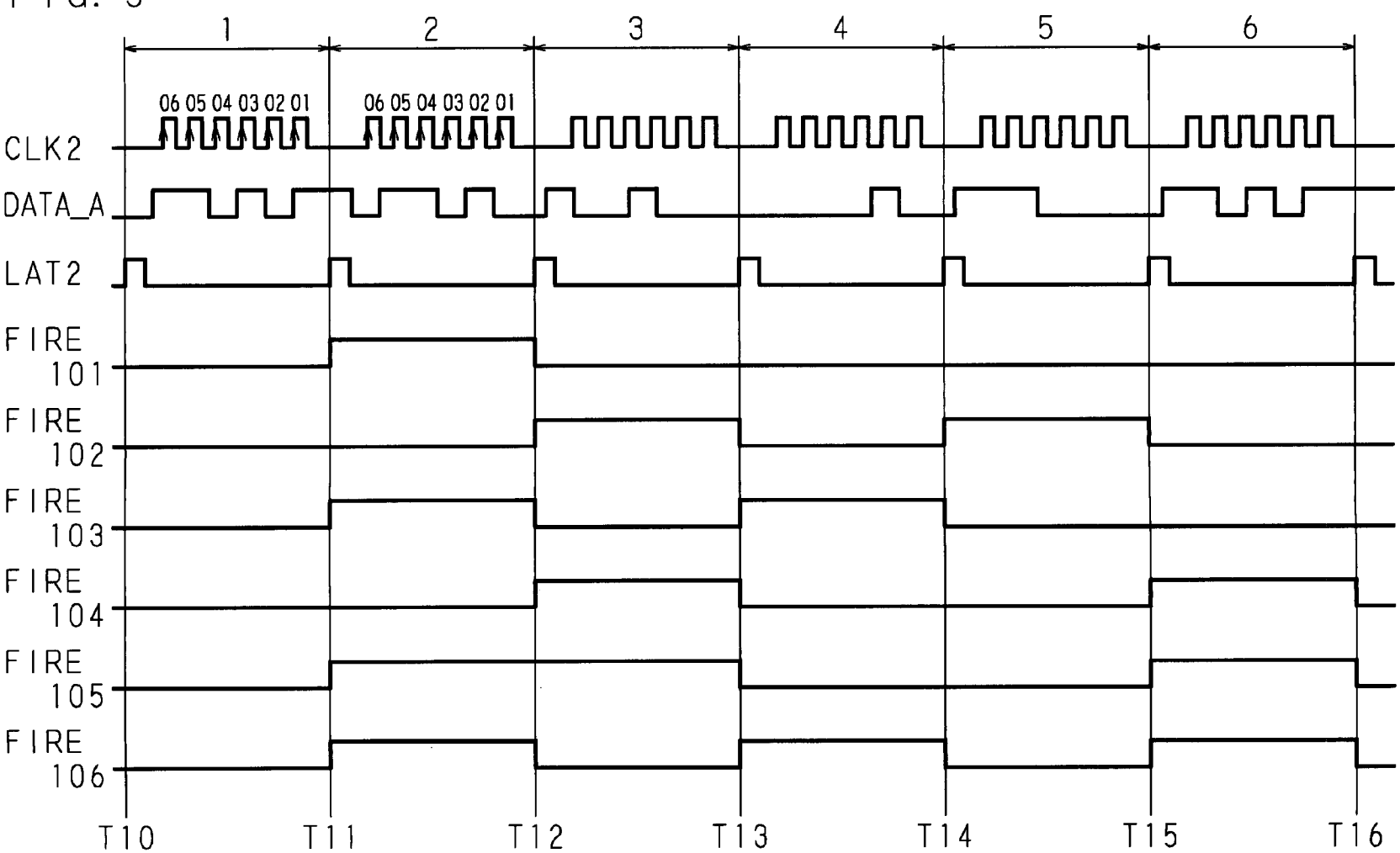
FIG. 3 is a timing chart diagram of an operation of the head driver according to the first embodiment (FIG. 2)

Next, referring to FIG. 3 illustrating the timing chart diagrams of respective signals transmitted to the head driver 21, the processing timing of respective signals in the head driver 21 is illustrated.

The drive signals are downloaded from the image memory 25 by the gate array 14, serially transmitted to the head driver 21 through the flexible flat cable 22, parallel developed by the first serial-parallel converting circuit 31, and outputted to the respective selectors 33 as the 3 bits selection signals from the first latching circuit 32. The respective selectors 33 select one of the plurality of kinds of recording waveform signals inputted by parallel transmission from the second serial-parallel converting circuit 35 based on respective selection signals and output it to the drivers 34 as the recording waveform signals FIRE 101-106 for ejecting ink from a plurality of nozzles (not illustrated) of the recording head 1.

On the other hand, as shown in FIG. 3, the serial signal DATA_A transmitted from the gate array 14 contains serially information on the six kinds of the recording waveform signals FIRE 101-106 from a front line in correspondence with the respective six clock pulses of the clock signal CLK2. Further, the serial signal DATA_A contains the information on the recording waveform signals FIRE 101-106 as respective groups (1 to 6) in correspondence with respective clock pulses sandwiched in order between the adjacent latching signals LAT2 so that the recording waveform signals FIRE 101-106 respectively contain one or more drive pulses.

Consequently, the second serial-parallel converting circuit 35 downloads firstly the serial signal DATA_A of the first group between the timing T10-T11 based on the rising edge of the clock pulse of the clock signal CLK2 and parallel converts it to a plurality of kinds of recording waveform signals. Then, when the latching signal LAT2 rises up at the timing T11, the latching circuit 36 latches each bit of the serial signal DATA_A developed in the second serial-parallel converting circuit 35 as the initial bit of the recording waveform signals FIRE 101-106.

For example, in FIG. 3, since the serial signal is "1" level at the rising of the clock pulse 06 in the first group, the recording waveform signal FIRE 106 is set to "1" level and since the serial signal is "1" level at the rising of the next clock pulse 05, the recording waveform signal FIRE 105 is also set to "1" level. Similarly, the recording waveform signal FIRE 104 is set to "0" level, the recording waveform signal FIRE 103 is set to "1" level, the recording waveform signal FIRE 102 is set to "0" level and the recording waveform signal FIRE 101 is set to "1" level.

Similarly, when the serial signal DATA_A of the second group is developed in the second serial-parallel converting circuit 35 and latched in the latching circuit 36 by the latching signal LAT2 at the timing T12, respective voltage levels of the recording waveform signals FIRE 101-106 set as the fore-description are switched respectively in accordance with the content of the serial signal DATA_A of the second group. For example, since the serial signal DATA_A is "0" level at the rising of the clock pulse 06, the recording waveform signal FIRE 106 is switched to "0" level at the timing T12.

Further, the respective voltage levels of the recording waveform signals FIRE 101-106 are respectively switched at the timings, T13, T14 and T15 in accordance with the content of the serial signals DATA_A of the groups 3, 4, 5 and 6. As a result, the recording waveform signals FIRE 101-106 are formed as recording waveforms including one or more drive pulses and inputted respectively in the respective selectors 33.

Further, the plurality of the recording waveform signals FIRE 101-106 inputted in the respective selectors 33 are selected based on the content of the drive signals outputted from the first latching circuit 32, namely the selection signals s0-0 to s0-2 and outputted to the electrodes of respective ink chambers of the recording head 1 through the drivers 34 as the drive pulse of the selected recording waveform signal, and ejection is carried out. By this, ink droplets in correspondence with the number or width of the drive pulse contained in the recording waveform signal are ejected based on the content of the selection signals s0-0 to s0-2, and the tone recording is carried out.

The serial signal DATA_A for generating the recording waveform signals FIRE 101-106 are repeatedly downloaded at a cycle of the timings T10 to T16 by the gate array 14 so far as recording condition is not changed and outputted repeatedly from the second serial-parallel converting circuit 35 and the second latching circuit 36 as the recording waveform signals FIRE 101-106.

The recording apparatus according to the first embodiment is driven by setting the length of the recording waveform signals FIRE 101-106 (length containing a portion not having the serial signal of the sixth group, in addition to the length from T11 to T16) as a recording cycle. The cycle of the latching signal LAT1 inputted in the first latching circuit 32 may be any one which is adapted to the above-mentioned recording cycle.

In the ink jet recording apparatus of color recording, the recording waveform signals for recording heads for respective colors are set in accordance with the property of ink, the serial signal for generating the recording waveform signals for all recording heads are serially transmitted and the plurality of recording waveform signals are parallel developed for each recording head. In this case, those having the bit number with the number of recording waveform signals×the number of the recording heads are used for the second serial-parallel converting circuit 35 and the second latching circuit 36. Alternatively, it can be also configured so that the second serial-parallel converting circuit 35 and the second latching circuit 36 are provided for each recording head and the serial signal for generating the recording waveform signals are serially transmitted for each recording head from the gate array 14.

Further, it can be also configured so that the serial signal DATA_A is appropriately rewritten so that the recording waveform signals FIRE 101-106 are changed in accordance with recording condition, transmitted from the host computer 26 and stored in the RAM 13 or the image memory 25. For example, when a lot of image data which are nearly simultaneously ejected are transmitted from the host computer 26, the serial signals DATA_A which are set so that a lot of drive pulses are not duplicated are transmitted together with image data in order to prevent power peak or in order to prevent cross talk.

Further, it can be also configured so that the serial signal DATA_A outputted from the gate array 14 is corrected in accordance with environmental condition such as temperature.

The first embodiment is described as the ink jet recording apparatus in the above, but it is not limited to this, and can be also applied as recording apparatuses using an impact type recording head, a thermal type recording head and the like.

Further, it can be also applied to not only the tone control of recording density (printing density), but also historical control, namely to select the recording waveform depending on the presence or absence of previous or next recording signals considering vibration remaining in an impact element of the impact type recording head, and to select the recording waveform depending on the presence or absence of previous or next recording signals considering heat remaining in a heater element of the thermal type recording head.

According to the first embodiment, the serial signal for generating the plurality of kinds of recording waveform signals serially transmitted is downloaded in order by the serial-parallel converting circuit based on the clock signal transmitted from the signal transmission circuit and thereby, parallel-converted; therefore a plurality of kinds of parallel recording waveform signals are generated.

According to the first embodiment, the serial signal ("1" level or "0" level) serially transmitted which corresponds to the respective clock pulses (for example, the timing of the rising edge of each of the clock pulses) in the clock signal is downloaded in order by the serial-parallel converting circuit and converted to parallel signals corresponding to the number of kinds of recording waveform signals. Then, they are outputted as a plurality of kinds of parallel recording waveform signals based on the latching signal outputted from the signal transmission circuit.

According to the first embodiment, the latching signals are repeatedly outputted at a predetermined cycle sandwiching the group of a constant number of clock pulses and a plurality of kinds of parallel recording waveform signals are outputted based on the latching signals. Further, since the converted parallel signals are changed based on a serial signal serially transmitted which corresponds to the next group of a constant number of clock pulses, a plurality of kinds of parallel recording waveform signals outputted are changed at the predetermined cycle.

According to the first embodiment, since the serial signal contains serially the states of the drive pulses of the recording waveform signals for each group of clock pulses, they are parallel converted by the serial-parallel converting circuit based on the clock signal and the recording waveform signals containing one or more clock pulses are outputted as a plurality of kinds of parallel recording waveform signals.

According to the first embodiment, since the recording waveform signals are outputted repeatedly at a constant cycle, the selection of the predetermined recording waveform signals based on the selection signal is smoothly carried out.

According to the first embodiment, the number of signal lines for the serial signal transmitted through the flexible cable is reduced.

According to the first embodiment, it is possible to minutely control the drive for each actuator and the ejected quantity of ink droplets can be easily controlled.

The following illustrates a second embodiment with reference to the drawings. The recording apparatus according to the second embodiment is a well-known ink jet recording apparatus in which a recording head is mounted on a carriage which moves reciprocally along a recording medium and ejects ink droplets toward the recording medium.

Figure 4:
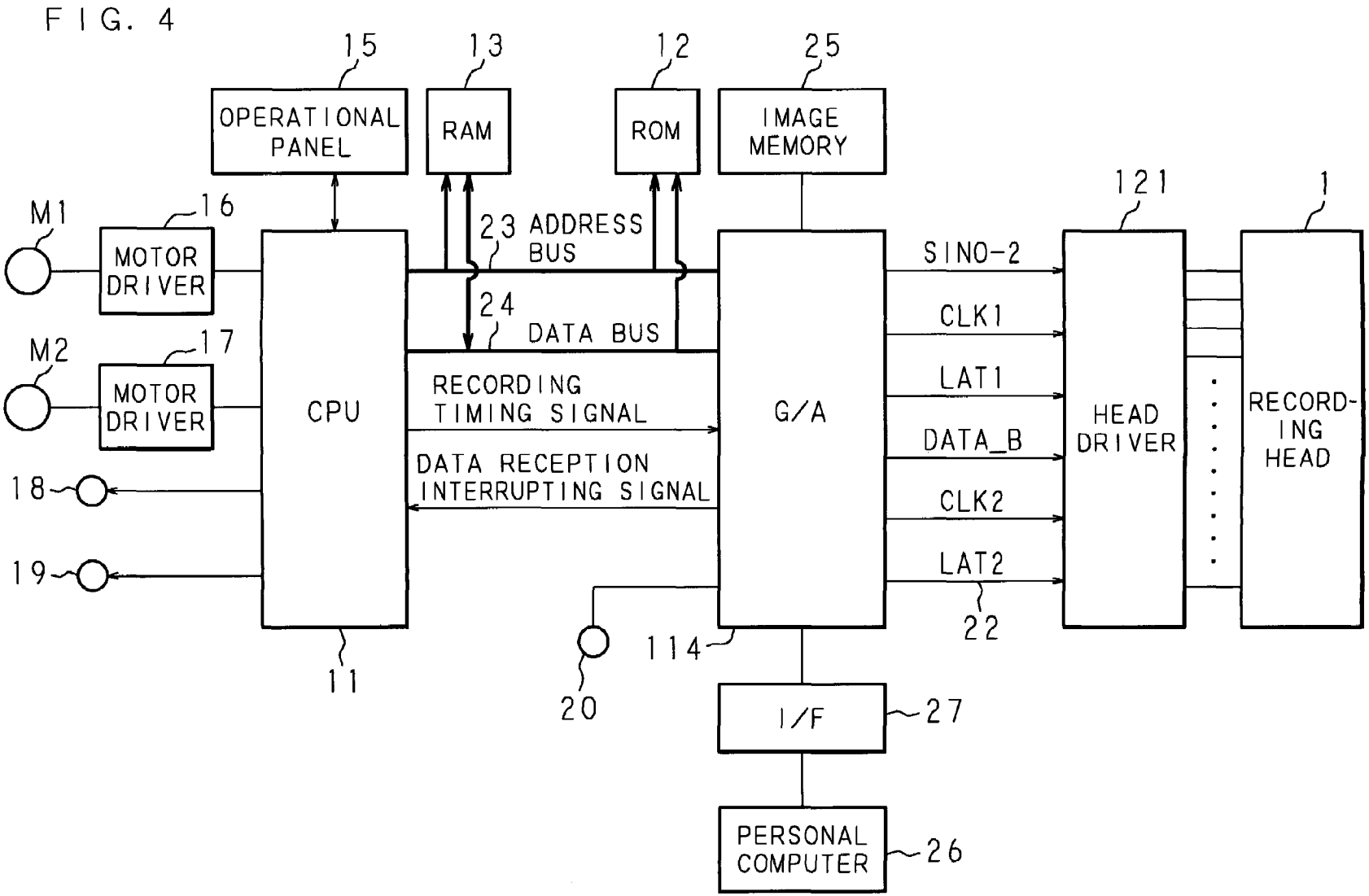
FIG. 4 is a block diagram illustrating the electrical composition of an ink jet recording apparatus according to a second embodiment.

FIG. 4 is a block diagram illustrating the electrical composition of a control device for controlling the ink jet recording apparatus according to the second embodiment. Since the second embodiment is the same composition as the above-mentioned first embodiment except the gate array and head driver, the same codes are imparted and its illustration is abbreviated.

As shown in FIG. 4, the recording head 1 is driven by a head driver 121 as a drive circuit. The head driver 121 is mounted on the carriage together with the recording head 1. Further, the head driver 121 is connected with the gate array 114 through a harness cable 22 (a flexible flat cable) and the head driver 121 is controlled by the gate array 114.

The recording head 1 is not specifically illustrated, but ejects ink droplets from nozzles by respectively increasing and decreasing the volume of respective ink chambers storing a plurality of ink, by driving actuators including a piezoelectric element, an electrostriction element and the like. Electrodes for driving the actuators are provided for respective nozzles, and connected with the head driver 121. The head driver 121 generates drive pulses having the recording waveforms suitable for the recording head 1 and applies them to respective electrodes based on control of the gate array 114. The encoder sensor 20 detecting the position of the carriage is connected with the gate array 114.

The CPU 11 is connected with the ROM 12, the RAM 13 and the gate array 114 through an address bus 23 and a data bus 24. The CPU 11 generates recording timing signal and reset signal in accordance with the program stored in the ROM 12 and transmits the respective signals to the gate array 114. The serial signal for generating a plurality of recording waveform signals described later is preliminarily stored in the ROM 12, or transmitted together with the recording signal from a host computer 26 through an interface 27, stored in the RAM 13 or the image memory 25 and outputted to the gate array 114 at recording operation.

The gate array 114 stores image data which are transmitted from the host computer 26 (personal computer) as an external instrument through the interface 27, in an image memory 25. Further, the gate array 114 generates data reception interrupting signal based on data which are transmitted from the host computer 26 through the interface 27 and transmits the data reception interrupting signal to the CPU 11. Then, the gate array 114 generates the clock signal CLK1 and the latching signal LAT1 in accordance with the recording timing signal and the control signal from the encoder sensor 20 and transmits the drive signals SIN0-2 (selection data) for forming image data on the recording medium synchronously with the clock signal CLK1, to the head driver 121 based on image data stored in the image memory 25. Further, the gate array 114 generates the clock signal CLK2 and the latching signal LAT2 having cycles different from those of the clock signal CLK1 and the latching signal LAT1 in accordance with the recording timing signal and the control signal from the encoder sensor 20 and transmits a serial signal DATA_B for generating the plurality of recording waveform signals to the head driver 121 synchronously with the clock signal CLK2. Respective signals connecting the gate array 114 with the head driver 121 are transmitted through the harness cable 22 connecting the head driver 121 with the gate array 114.

Figure 5:
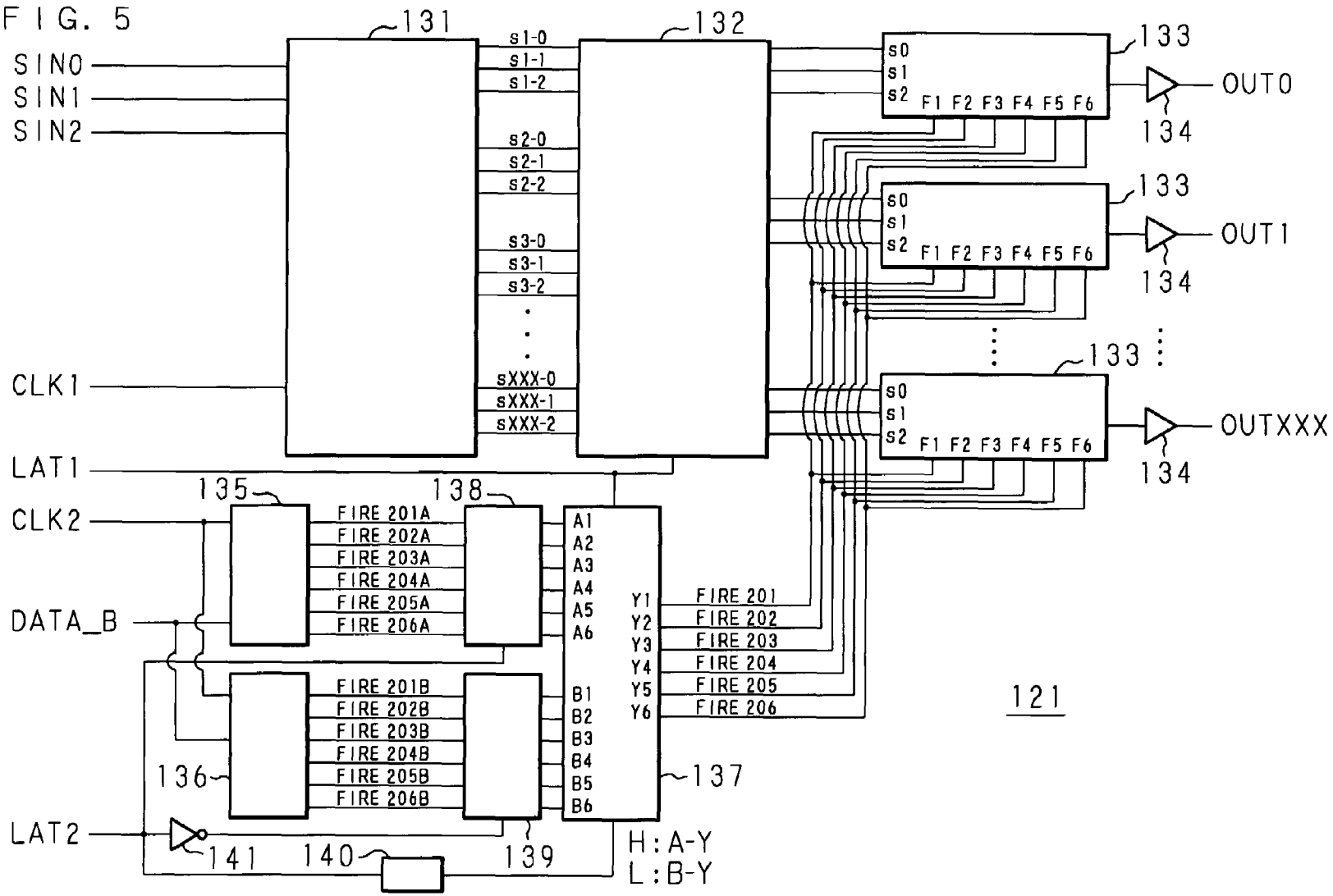
FIG. 5 is a block diagram illustrating a head driver according to the second embodiment.

Further, as shown in FIG. 5, the head driver 121 is provided with the first serial-parallel converting circuit 131 for serial-parallel converting the drive signals SIN0-2 to parallel signals corresponding to respective actuators, the first latching circuit 132, selectors 133 (selecting unit), drivers 134, the second and third serial-parallel converting circuits 135 and 136 for serial-parallel converting the serial signal for generating a plurality of recording waveform signals to a plurality of kinds of recording waveform signals and the second and third latching circuits 138 and 139. Further, it is provided with a switching circuit 137 which switches parallel signals generated in the second and third serial-parallel converting circuits 135 and 136 based on the rising edge and falling edge of the latching signal transmitted from the gate array 114 and outputs them to the selectors 133 as the plurality of kinds of recording waveform signals.

When the recording head 1 is, for example, a 64 channels multi-nozzle head in which 64 of ink chambers are provided, the first serial-parallel converting circuit 131 is constituted from a shift resistor with 64 bits length. The drive signals SIN0-2 which are serially transmitted from the gate array 114 synchronously with the clock signal CLK1 is inputted in the first serial-parallel converting circuit 131 and the drive signals are converted to parallel signals in accordance with the rising of the clock pulse of the clock signal.

Selection signals s0, s1 and s2 are set for each channel by serial-parallel conversion of the drive signals. Respective drive signals are constituted from 3 bits selection signal respectively and designed so as to select from the plurality of kinds of recording waveform signals including non printing depending on the combination of bits.

The first latching circuit 132 latches respectively parallel signals generated in the first serial-parallel converting circuit 131 (corresponding to respective actuators of the recording head 1) in accordance with the rising edge (of pulse) of the latching signal LAT1 transmitted from the gate array 114.

On the other hand, the second and third serial-parallel converting circuits 135 and 136 are arranged in parallel and constituted from a shift resistor with 6 bits length corresponding to the number of kinds of recording waveforms. The serial signal DATA_B which is serially transmitted from the gate array 114 synchronously with the clock signal CLK2 is inputted in the second and third serial-parallel converting circuits 135 and 136. Further, the serial signal DATA_B corresponding to the rising edge of the clock pulse of the clock signal CLK2 is converted to parallel signals FIRE 201A-206A by the second serial-parallel converting circuit 135. On the other hand, the serial signal DATA_B corresponding to the falling edge of the clock pulse of the clock signal CLK2 is converted to parallel signals FIRE 201B-206B by the third serial-parallel converting circuit 136.

The second latching circuit 138 latches the output signals FIRE 201A-206A of the second serial-parallel converting circuit 135 based on the rising edge of the latching signal LAT2 transmitted from the gate array 114 and the third latching circuit 139 latches the output signals FIRE 201B-206B of the third serial-parallel converting circuit 136 based on the falling edge of the latching signal LAT2 (transmitted through inversion circuit 141). Further, the switching circuit 137 inputs the latching signal LAT2 through a delay circuit 140 at a little later than the both latching circuits 138 and 139, downloads alternately the output signals FIRE 201A-206A and FIRE 201B-206B of the both latching circuits 138 and 139 based on the rising edge and falling edge of the latching signal LAT2 and outputs respectively them to 64 selectors 133 provided at every channel, as the plurality of kinds of recording waveform signals FIRE 201-206.

Respective selectors 133 select respectively one from the plurality of kinds of recording waveform signals FIRE 201-206 which are transmitted from the switching circuit 137, based on the drive signals (including selection signals, s0, s1 and s2) which are parallel outputted from the first latching circuit 132, and output the selected recording waveform signal, to the drivers 134. For example, when six kinds of recording waveform signals respectively having different pulse numbers are prepared, the drive signals include three selection signals, s0, s1 and s2, and one of the recording waveform signals is selected in accordance with the input of the selection signals. Specifically, when the selection signals, s0, s1 and s2 are 0, 0, 0, non printing is selected. When the selection signals are 0, 0, 1, the recording waveform signal FIRE 201 is selected. When the selection signals are 0, 1, 0, the recording waveform signal FIRE 202 is selected. When the selection signals are 1, 0, 0, the recording waveform signal FIRE 203 is selected. Thus, 7 tones including non printing can be obtained for each nozzle.

Each of the drivers 134 generates a drive pulse of voltage suitable for the recording head 1 based on one of the recording waveform signals FIRE 201-206 outputted from the corresponding selector 133, and outputs the generated drive pulse to the electrode (actuator) of each ink chamber of the recording head 1, as the drive pulse of the selected recording waveform signal.

Further, when the recording head 1 does not have 64 channels, the bit length of the first serial-parallel converting circuit 131 and the numbers of the selectors 133 and the drivers 134 may be set to the same as the number of the channels of the recording head 1.

Figure 6:
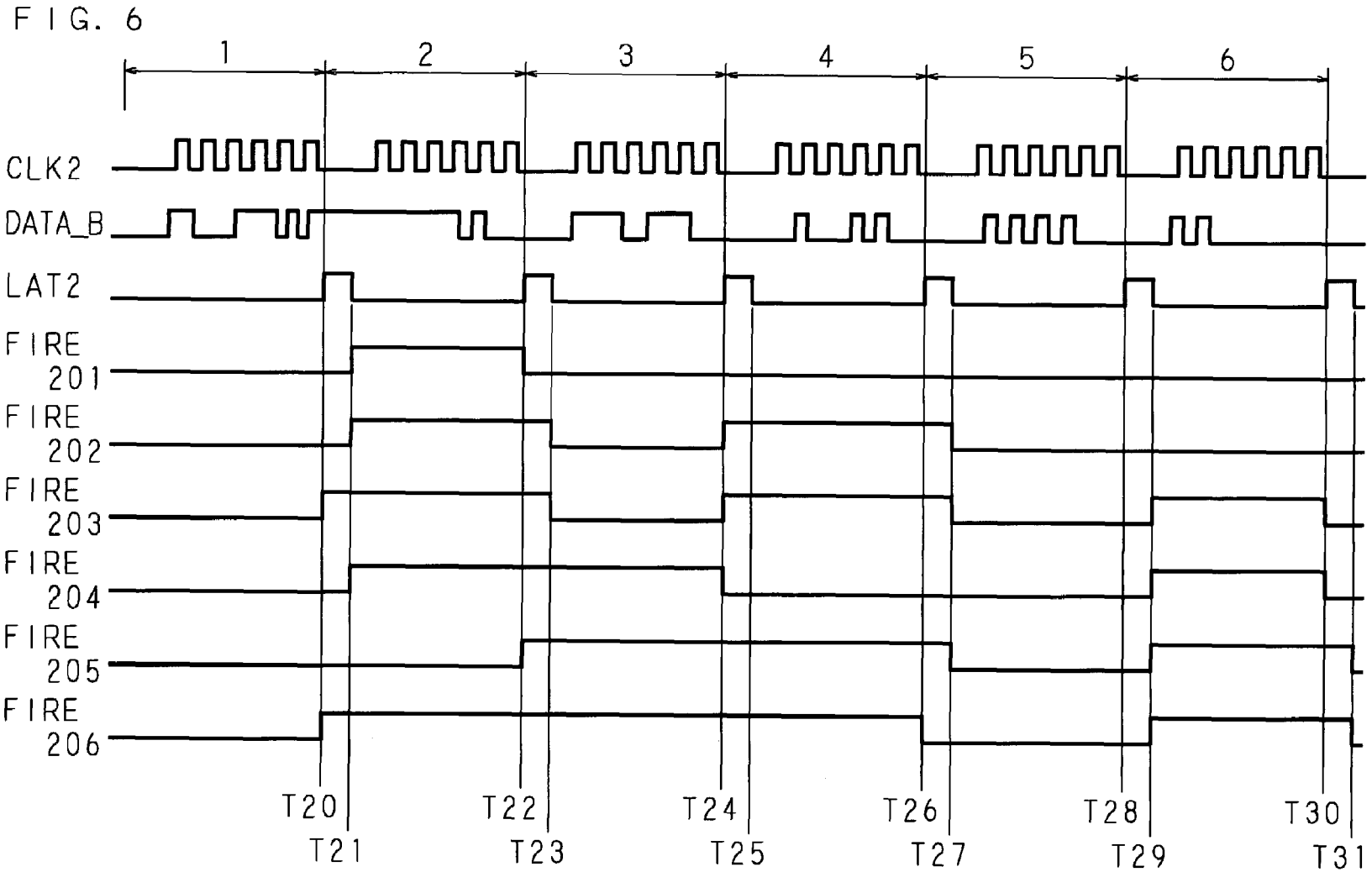
FIG. 6 is a timing chart diagram of an operation of the head driver according to the second embodiment (FIG. 5)
Figure 7:
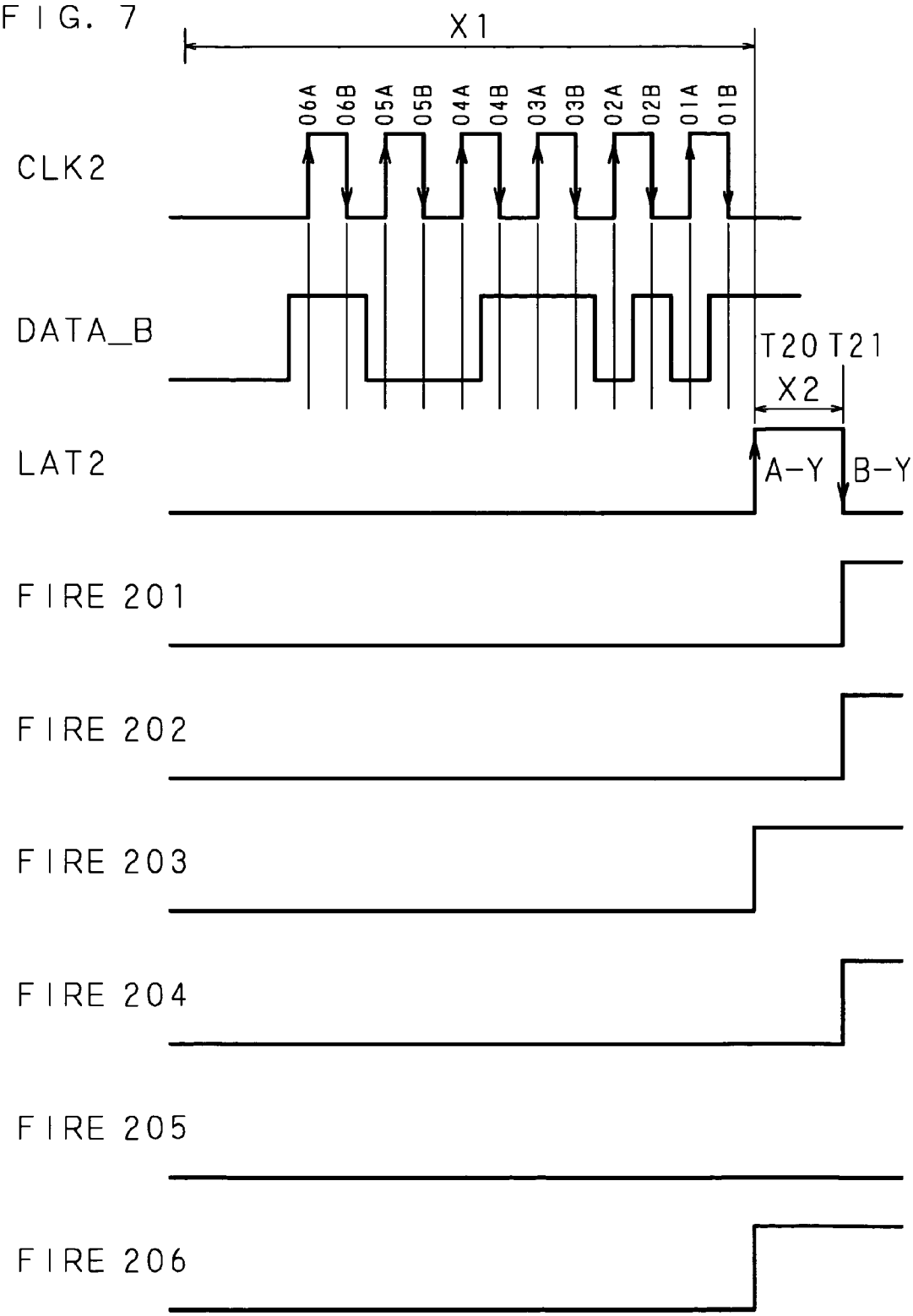
FIG. 7 is a partially enlarged diagram of the timing chart diagram of FIG. 6.

Successively, referring to FIGS. 6 and 7 illustrating the timing charts of respective signals transmitted to the head driver 121, the processing timing of respective signals in the head driver 121 is illustrated.

The drive signals SIN0-2 are downloaded from the image memory 25 by the gate array 114 and serially transmitted to the head driver 121 through the flexible flat cable 22. Further, the serial signal DATA_B, the clock signals CLK1 and CLK2 and the latching signals LAT1 and LAT2 are serially transmitted to the head driver 121 from the gate array 114 through the flexible flat cable 22.

As shown in FIG. 6, the serial signal DATA_B outputted from the gate array 114 contain serially information on six kinds of the recording waveform signals FIRE 201-206 from a front line in correspondence with 6 clock pulses of the clock signal CLK2. Further, the serial signal DATA_B contain the information on the recording waveform signals FIRE 201-206 as respective groups (1 to 6) in correspondence with respective clock pulses sandwiched in order between the adjacent latching circuits LAT2 so that the recording waveform signals FIRE 201-206 contain respectively one or more drive pulses.

The second serial-parallel converting circuit 135 converts firstly the serial signal DATA_B of the first group corresponding to the rising edge 06A-01A of the clock pulse of the clock signal CLK2 to the parallel signals FIRE 206A-201A (refer to FIG. 6) corresponding to the kinds of recording waveform signals, and on the other hand, the third serial-parallel converting circuit 136 converts the serial signal DATA_B of the first group corresponding to the falling edge 06B-01B of the clock pulse to the another parallel signals FIRE 206B-201B (refer to FIG. 6) which are successive to the parallel signals FIRE 206A-201A.

For example, in FIG. 7, since the serial signal DATA_B is "1" level at the rising edge 06A of the first clock pulse, the recording waveform signal FIRE 206A is set to "1" level. Since the serial signal is "0" level at the rising edge 05A of the next clock pulse, the recording waveform signal FIRE 205A is also set to "0" level. Similarly, the recording waveform signal FIRE 204A is set to "0" level, the recording waveform signal FIRE 203A is set to "1" level, the recording waveform signal FIRE 202A is set to "0" level and the recording waveform signal FIRE 201A is set to "0" level. On the other hand, since the serial signal is "1" level at the first falling edge 06B of the first clock pulse, the recording waveform signal FIRE 206B is set to "1" level. Since the serial signal is "0" level at the falling edge 05B of the next clock pulse, the recording waveform signal FIRE 205B is also set to "0" level. Similarly, the recording waveform signal FIRE 204B is set to "1" level, the recording waveform signal FIRE 203B is set to "1" level, the recording waveform signal FIRE 202B is set to "1" level and the recording waveform signal FIRE 201B is set to "1" level.

Further, the second latching circuit 138 downloads at T20 timing the parallel signals FIRE 201A-206A which were developed in the second serial-parallel converting circuit 135 at the rising edge A-Y at which the latching signal is changed from "0" level to "1" level, and the third latching circuit 139 downloads at T21 timing the parallel signals FIRE 201B-206B which were developed in the third serial-parallel converting circuit 136 at the falling edge B-Y at which a latching pulse of the latching signal is changed from "1" level to "0" level. The switching circuit 137 downloads the parallel signals FIRE 201A-206A and the parallel signals FIRE 201B-206B in order and sets the initial waveform (voltage level) of a plurality of kinds of recording waveform signals FIRE 201-206 in combination. Similarly, the serial signal DATA_B of the second group is parallel developed in the second serial-parallel converting circuit 135 at the rising edge of clock pulse and parallel developed in the third serial-parallel converting circuit 136 at the falling edge of clock pulse. The signals which were developed in the second serial-parallel converting circuit 135 are downloaded in the second latching circuit 138 at the rising of the latching signal LAT2 of the timing T22 and the signals which were developed in the third serial-parallel converting circuit 136 are downloaded in the third latching circuit 139 at the rising of the latching signal LAT2 of the timing T23, and sequentially downloaded by the switching circuit 137. As a result, as described above, the respective voltage level of the recording waveform signals FIRE 201-206 which were set at the timings T20 and T21 are respectively switched in accordance with the content of the serial signal DATA_B of the second group. For example, the recording waveform signal FIRE 201 which was raised at the timing T21 is switched to "0" level at the timing T22.

Further, the respective voltage levels of the recording waveform signals FIRE 201-206 are respectively switched at the timings, T23 to T31 in accordance with the content of the serial signal DATA_B of the groups 3, 4, 5 and 6. As a result, the recording waveform signals FIRE 201-206 are formed as recording waveforms including one or more drive pulses and inputted respectively in the respective selectors 133. Accordingly, since the serial signal is transmitted by utilizing not only the rising edge of clock pulse of the clock signal but also the falling edge, the serial signal can be transmitted to the head driver 121 even if time X2 changing the recording waveforms (namely, time between the displacement points of the recording waveform) is shorter than time X1 serially transmitting a group of the serial signal.

One of the plurality of recording waveform signals FIRE 201-206 inputted in the respective selectors 133 from the switching circuit 137 is selected based on the drive signals (including the selection signals s0-0, s0-1 and s0-2) inputted from the first latching circuit 132, and the selected recording waveform signal is outputted in the drives 134. The drive pulses of the selected recording waveform signals are outputted from the drivers 134 to the recording head 1 for ejecting ink from a plurality of nozzles (not illustrated) respectively and recording (printing) is carried out.

The serial signal DATA_B from the group 1 to the group 6 for generating the recording waveform signals FIRE 201-206 is repeatedly downloaded by the gate array 114 so far as recording condition is not changed, and outputted repeatedly from the second and third serial-parallel converting circuits 135 and 136 and the switching circuit 137 as the recording waveform signals FIRE 201-206. The recording apparatus of the second embodiment is driven by setting the length of the recording waveform signals FIRE 201-206 as a recording cycle. The cycle of the latching signal LAT2 inputted in the first latching circuit 132 may be any one which is adapted to the above-mentioned recording cycle.

In the ink jet recording apparatus of color recording, the recording waveform signals for recording heads for respective colors are set in accordance with the property of ink, the serial signal for generating the recording waveform signals for all recording heads are serially transmitted and the plurality of kinds of recording waveform signals are developed for each recording head in parallel. In this case, those having the bit number with the number of recording waveform signals× the number of the recording heads are used for the second and third serial-parallel converting circuits 135 and 136. Alternatively, it can be also configured so that the second and third serial-parallel converting circuits 135 and 136 are provided for each recording head and the serial signal is serially transmitted from the gate array 114 for each recording head.

Further, it can be also configured so that the serial signal DATA_B is appropriately rewritten so that the recording waveform signals FIRE 201-206 are changed in accordance with recording condition, transmitted from the host computer 26 and stored in the RAM 13 or the image memory 25. For example, when a lot of image data which are nearly simultaneously ejected are transmitted from the host computer 26, the serial signal DATA_B which is set so that a lot of drive pulses are not duplicated is transmitted together with image data in order to prevent power peak or in order to prevent cross talk.

Further, it can be also configured so that the serial signal DATA_B outputted from the gate array 114 is corrected in accordance with environmental condition such as temperature. The ink jet recording apparatus was illustrated in the second embodiment, but it is not limited to that and can be also applied to recording apparatuses using an impact type recording head, a thermal type recording head and the like.

Further, it can be also applied to not only the tone control of recording density, but also historical control, namely to select the recording waveform depending on the presence or absence of previous or next recording signals considering vibration remaining in an impact element of the impact type recording head, and to select the recording waveform depending on the presence or absence of previous or next recording signals considering heat remaining in a heater element of the thermal recording head.

According to the second embodiment, for the serial signals which are serially transmitted from the signal transmission circuit, the serial signal corresponding to the rising edge of each of clock pulses in the clock signal which is transmitted from the signal transmission circuit is converted to parallel signals by the first serial-parallel converting circuit. On the other hand, the serial signal corresponding to the falling edge of each of the clock pulses is converted to parallel signals by the second serial-parallel converting circuit. Then the plurality of kinds of recording waveform signals are generated using both parallel signals.

According to the second embodiment, the latching signal is outputted at a predetermined cycle sandwiching the group of a constant number of clock pulses and a plurality of kinds of parallel recording waveform signals are outputted based on the latching signal. Further, since a plurality of kinds of the parallel recording waveform signals are changed based on the serial signal serially transmitted which corresponds to the next group of clock pulses, the parallel signals are changed for each predetermined cycle.

According to the second embodiment, since the serial signal serially transmitted contains serially the states of the drive pulses of respective recording waveform signals for each group of clock pulses, the recording waveform signals containing one or more clock pulses are generated and outputted for each predetermined cycle by the serial-parallel conversion at the drive circuit.

According to the second embodiment, the number of signal lines for the serial signal transmitted through the flexible cable is reduced.

According to the second embodiment, it is possible to minutely control the drive for each actuator and the ejected quantity of ink droplets can be easily controlled.

The following illustrates a third embodiment with reference to the drawings. Further, the recording apparatus according to the third embodiment is a well-known ink jet recording apparatus in which a recording head is mounted on a carriage which moves reciprocally along a recording medium and ejects ink droplets toward the recording medium.

Figure 8:
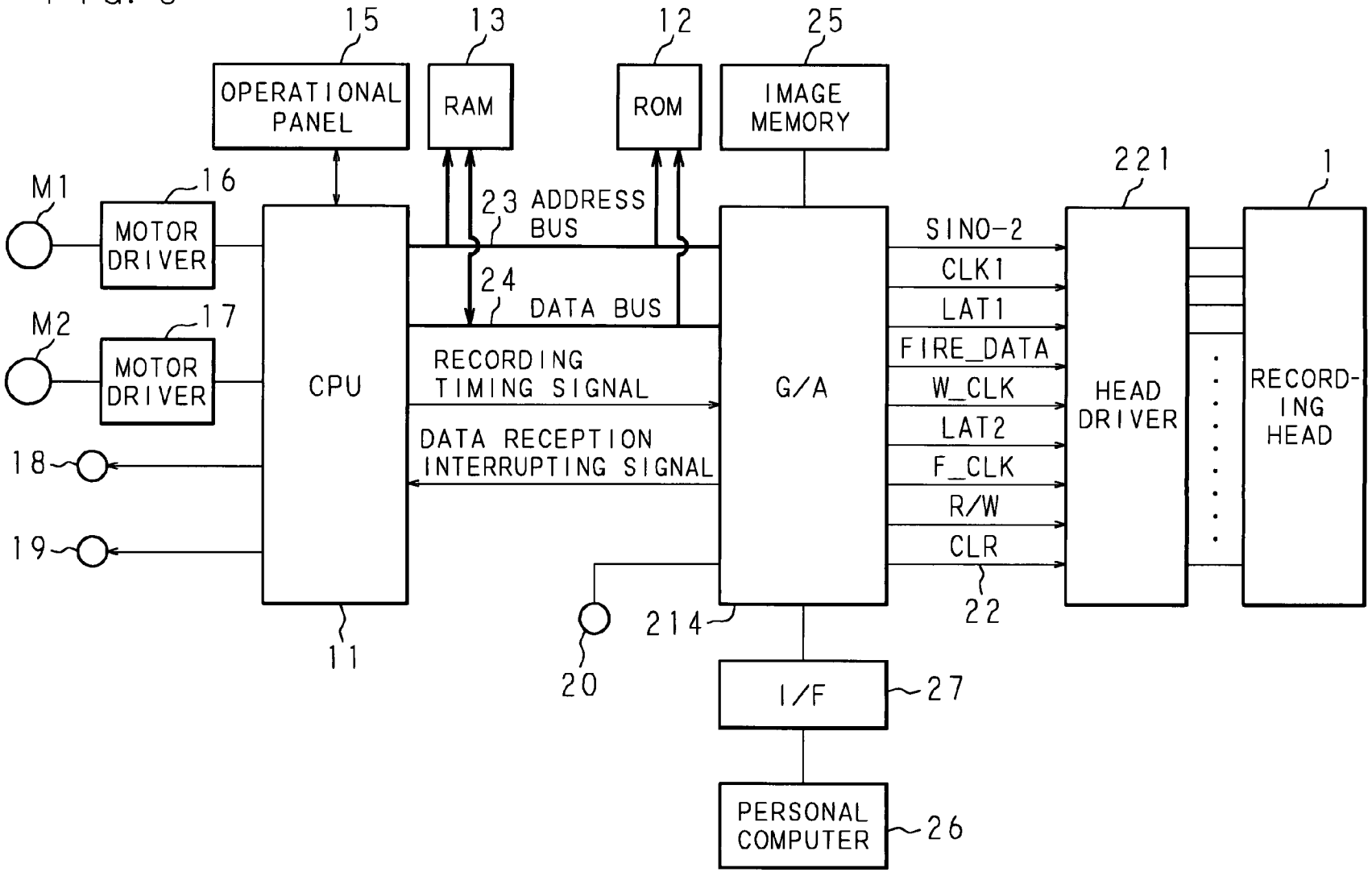
FIG. 8 is a block diagram illustrating an electrical composition of a control device controlling an ink jet recording apparatus according to a third embodiment.

FIG. 8 is a block diagram illustrating the electrical composition of a control device for controlling the ink jet recording apparatus according to the third embodiment. Further, since the third embodiment is the same composition as the above-mentioned first embodiment except the gate array and head driver, the same codes are imparted and its illustration is abbreviated.

As shown in FIG. 8, the recording head 1 is driven by a head driver 221 as a drive circuit. The head driver 221 is mounted on the carriage together with the recording head 1. Further, the head driver 221 is connected with the gate array 214 through a flexible flat cable 22 (a harness cable) and the head driver 221 is controlled by the gate array 214.

The recording head 1 is not specifically illustrated, but ejects ink droplets from a nozzle by respectively increasing and decreasing the volume of respective ink chambers storing a plurality of ink, by driving actuators including a piezoelectric element, an electrostriction element and the like. A plurality of electrodes for driving the actuators are provided for respective nozzles, and connected with the head driver 221. Further, a plurality of electrodes (actuators) are divided into a plurality of groups carrying out recording with the different kinds of color ink (recording material).

The head driver 221 generates drive pulses having the recording waveform suitable for the respective actuators of the recording head 1, based on control of the gate array 214 and applies them to respective electrodes. The encoder sensor 20 detecting the position of the carriage is connected with the gate array 214.

Figure 11A:
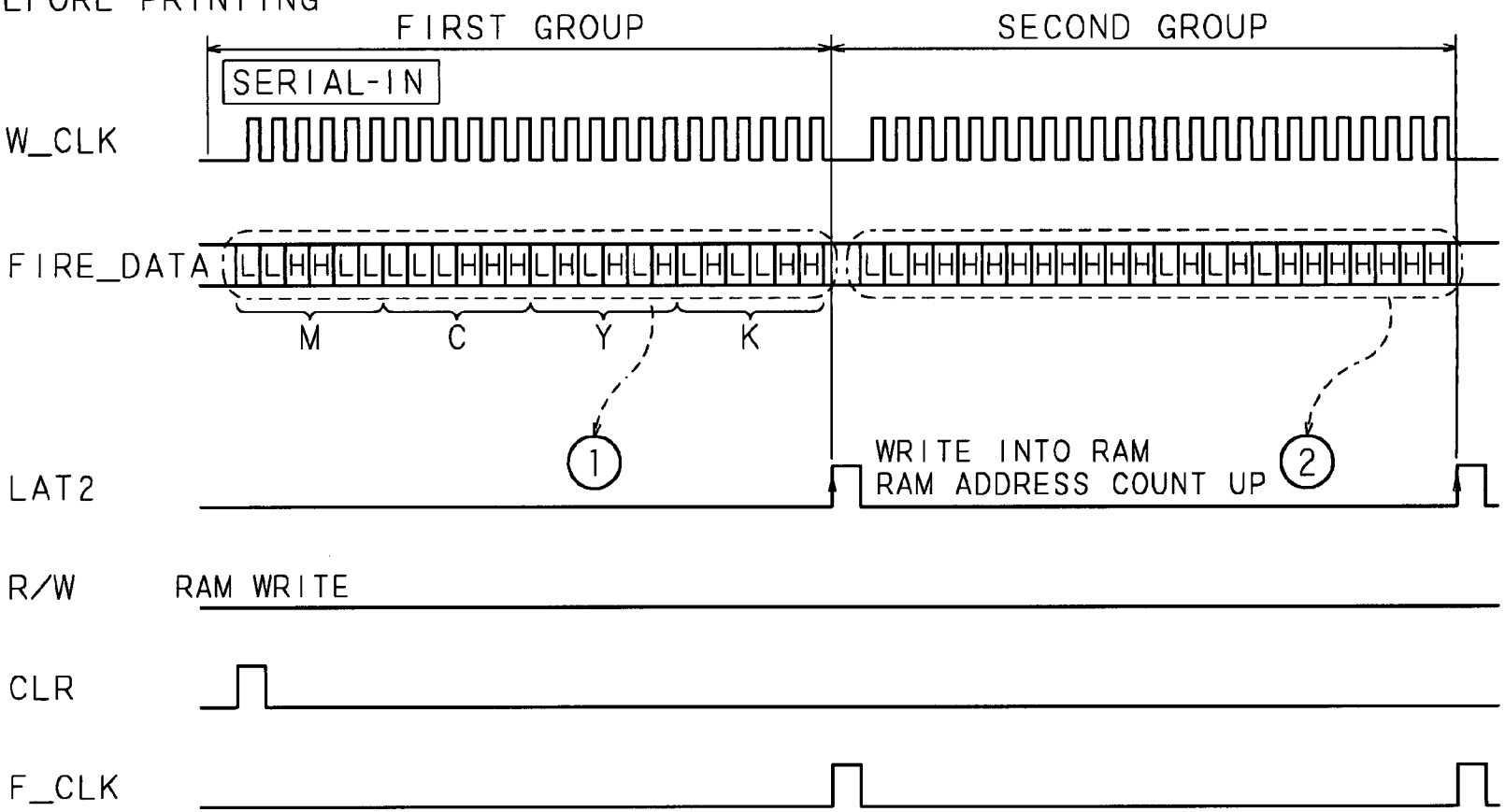
FIGS. 11A and 11B are timing chart diagrams showing an operation of the recording apparatus.

The CPU 11 is connected with the ROM 12, the RAM 13 and the gate array 214 through the address bus 23 and the data bus 24. The CPU 11 generates recording timing signal and reset signal in accordance with the program stored in the ROM 12 in advance, and transmits the respective signals to the gate array 214. The serial signal for generating a plurality of recording waveform signals described later is preliminarily stored in the ROM 12, or transmitted together with the recording signal from a host computer 26 through an interface 27, stored in the RAM 13 or the image memory 25 and serially outputted to the gate array 214 at recording operation. As described above, since the actuators are divided into a plurality of groups (K, Y, C, M) for respective color ink, the serial signal FIRE_DATA for generating the plurality of kinds of recording waveform signals arranges serially the total bits of those in which the recording waveform signals FIRE 301-336 of each group (K, Y, C, M) is made into one group bit-by-bit from the beginning as shown in FIG. 11A.

The gate array 214 temporarily stores image data which is transmitted from the host computer 26 (personal computer) as an external instrument through the interface 27, in an image memory 25. Further, the gate array 214 generates a data reception interrupting signal, based on a recording signal which is transmitted from the host computer 26 through the interface 27 and transmits the data reception interrupting signal to the CPU 11. Then, the gate array 214 generates the clock signal CLK1 and the latching signal LAT1 in accordance with the recording timing signal and the control signal from the encoder sensor 20 and transmits the drive signals SIN0-2 (selection data) for forming image data on the recording paper synchronously with the clock signal CLK1, to the head driver 221 based on image data temporarily stored in the image memory 25. Further, the gate array 214 generates clock signals W_CLK, F_CLK having cycles different from that of the clock signal CLK1, the latching signal LAT2 having a cycle different from that of the latching signal LAT1, a clear signal CLR, and a write/read signal W/R to and from the memory device 235 in accordance with the recording timing signal and the control signal from the encoder sensor 20, and transmits the serial signal FIRE_DATA for generating the plurality of recording waveform signals to the head driver 221 synchronously with the clock signals W_CLK, F_CLK. The transmission of the respective signals from the gate array 214 to the head driver 221 is carried through the flexible flat cable 22 connecting the head driver 221 with the gate array 214.

Figure 9:
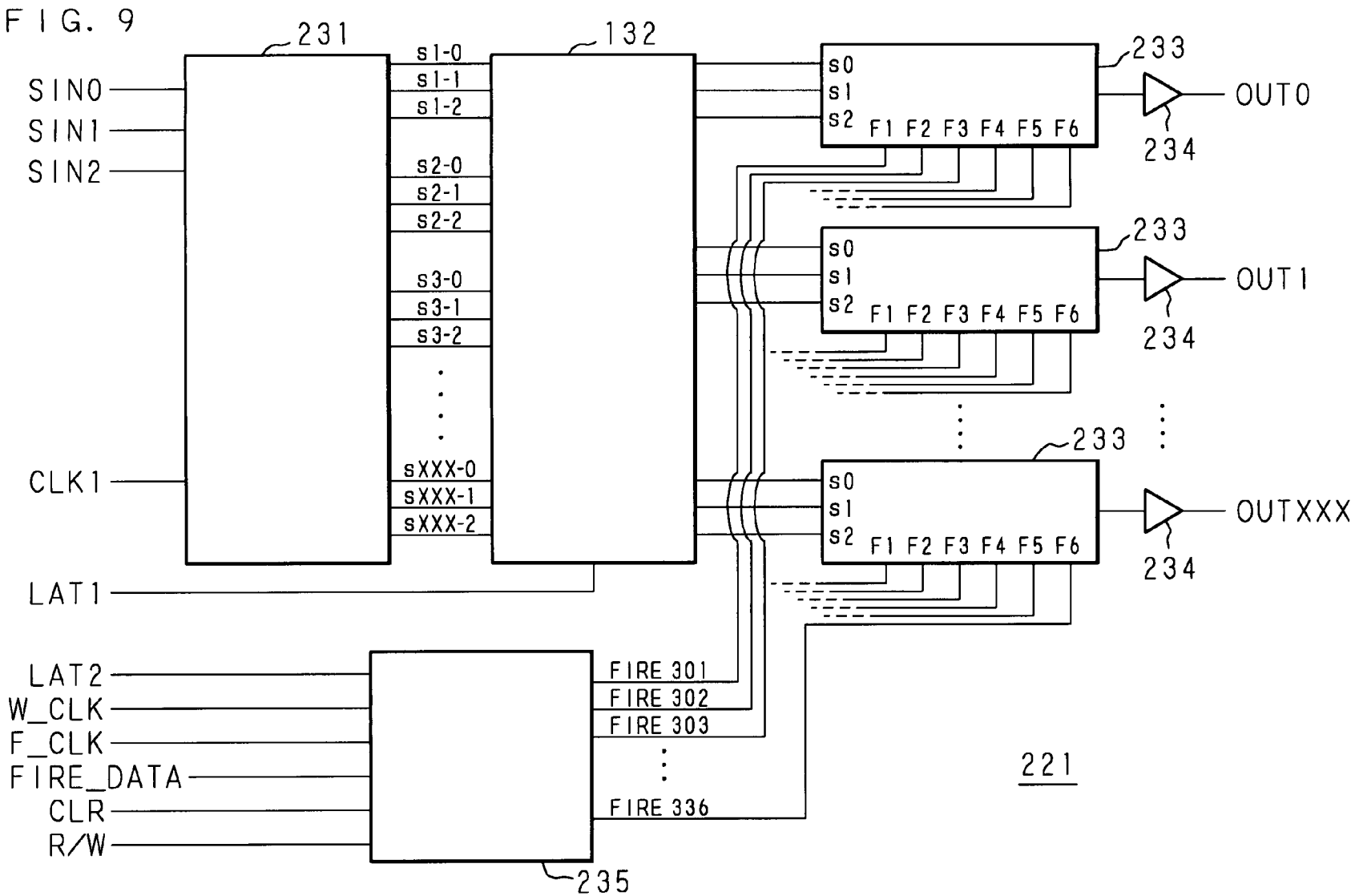
FIG. 9 is a block diagram illustrating a head driver according to the third embodiment.

Further, as shown in FIG. 9, the head driver 221 is provided with the first serial-parallel converting circuit 231 for serial-parallel converting the drive signals SIN0-2 to parallel signals (signals corresponding to respective actuators), the first latching circuit 232, selectors 233 (selecting unit), drivers 234 and the memory device 235.

When the recording head 1 is a 64 channels multi-nozzle head in which 64 of ink chambers are provided, the first serial-parallel converting circuit 231 is constituted from a shift resistor with the bits length of 64×the number of groups. The drive signals SIN0-2 are serially transferred to the first serial-parallel converting circuit 231 from the gate array 214 synchronously with the clock signal CLK1. The first serial-parallel converting circuit 231 carries out the serial-parallel conversion of the drive signals by converting the drive signals to parallel signals in accordance with the rising edge of clock pulse of the clock signal CLK1 and sets the selection signals s0, s1 and s2 for each chamber. Respective drive signals are constituted from 3 bits selection signal respectively and designed so as to select from the recording waveform signals including non printing depending on the combination of bits.

The first latching circuit 232 latches respectively parallel signals in accordance with the rising edge (of latching pulse) of the latching signal transmitted from the gate array 214.

It is configured so that the memory device 235 parallel converts the serial signal FIRE_DATA in order, based on the clock signal transmitted from the gate array 214, downloads and stores them in a location assigning address prior to recording (printing), thereby generates respectively a plurality of kinds (six kinds) of the recording waveform signals FIRE 301-336 to the group of respective actuators, to be stored. Further, in the printing, the plurality of kinds of recording waveform signals FIRE 301-336 which are stored in the memory device 235 are outputted to the selectors 233.

Each of 64 selectors 233 which is provided for each ink chamber (actuator) of the recording head 1 selects respectively one from the plurality of kinds of recording waveform signals FIRE 301-336 parallel outputted from the memory device 235, based on the drive signals (including selection signals) outputted from the first latching circuit 232, and output it to the driver 234.

Each of the drivers 234 generates the drive pulse of voltage suitable for each actuator of the recording head 1, based on one of the recording waveform signals FIRE 301-336 respectively outputted from each of the selectors 233, and outputs the drive pulse of the selected recording waveform signal to the electrode (actuator) of each ink chamber of the recording head 1.

Further, when the recording head 1 does not have 64 channels, the bit length of the first serial-parallel converting circuit 231 and the numbers of the selectors 233 and the drivers 234 may be set to the same as the number of the channels of the recording head 1.

Figure 10:
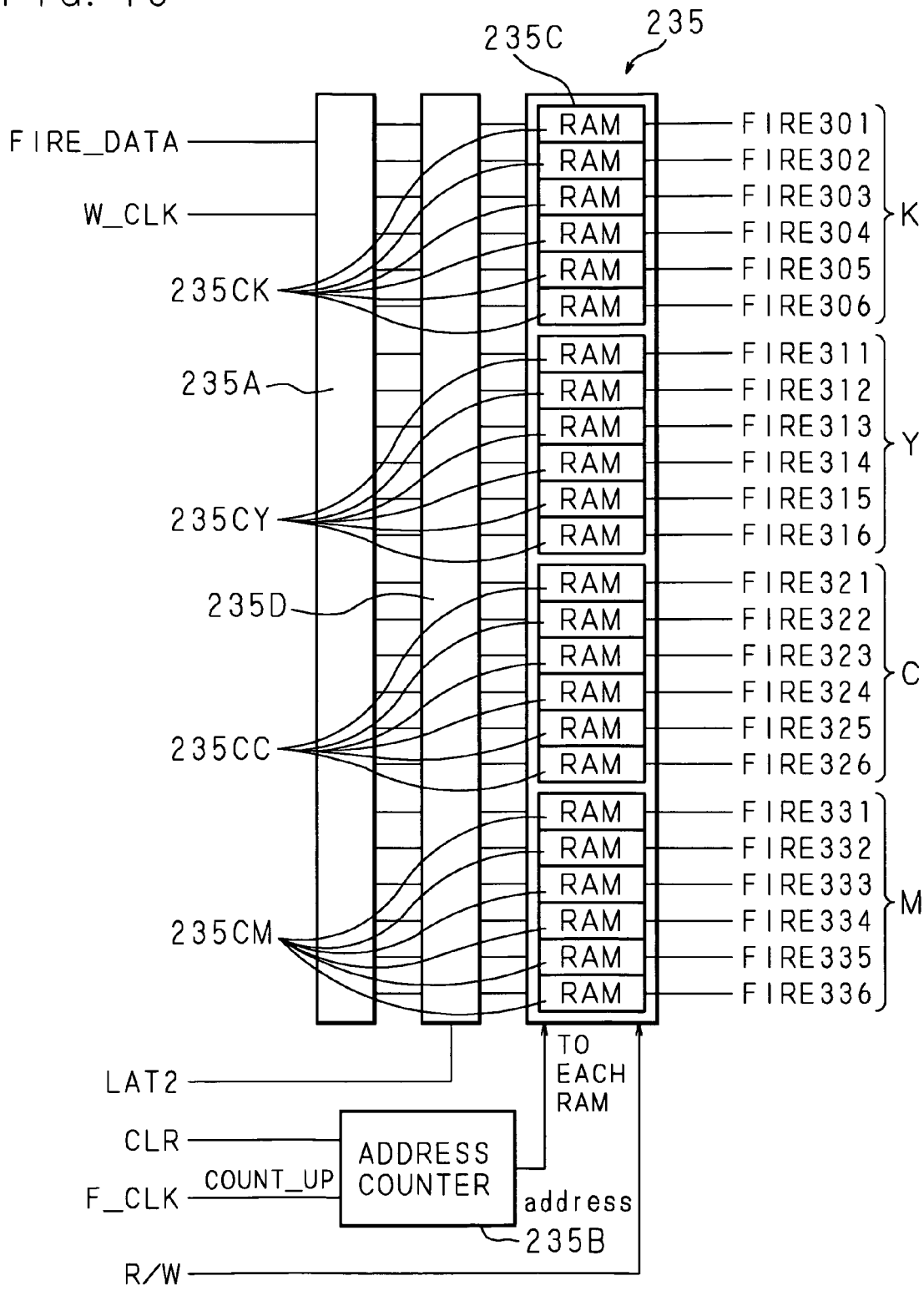
FIG. 10 is a block diagram illustrating a specific composition of the recording apparatus.

In the third embodiment, as shown in FIG. 10, the memory device 235 is provided with the second serial-parallel converting circuit 235A, the second latching circuit 235D, an address counter 235 B and a plurality of memories 235C.

The second serial-parallel converting circuit 235A is constituted from a shift resister having a bit length with the bit length, corresponding to the number of the kinds (6 in the third embodiment) of the recording waveform signals, ×group number (4 in the third embodiment), the second latching circuit 235D is also similarly configured, and the memories 235C are also provided with the number corresponding to the bits by the lengths (bit lengths) of the recording waveform signals. The serial signal FIRE_DATA is serially transferred to the second serial-parallel converting circuit 235A synchronously with the clock signal from the gate array 214 (refer to FIG. 1A). Further, the first group consisting of respective one bit at the beginning in the total recording waveform signals FIRE 301-336 of respective groups (K, Y, C, M) is developed by parallel converting the serial signal FIRE_DATA to the plurality of kinds of recording waveform signals FIRE 301-336 based on the rising edge of clock pulse of the clock signal W_CLK. Namely, the serial signal FIRE_DATA ("H" level or "L" level) is converted to parallel signals based on the clock pulse of the clock signal W_CLK. The second latching circuit 235D latches the parallel signals in accordance with the rising edge of the latching signal LAT2 transmitted from the gate array 214.

Figure 11B:
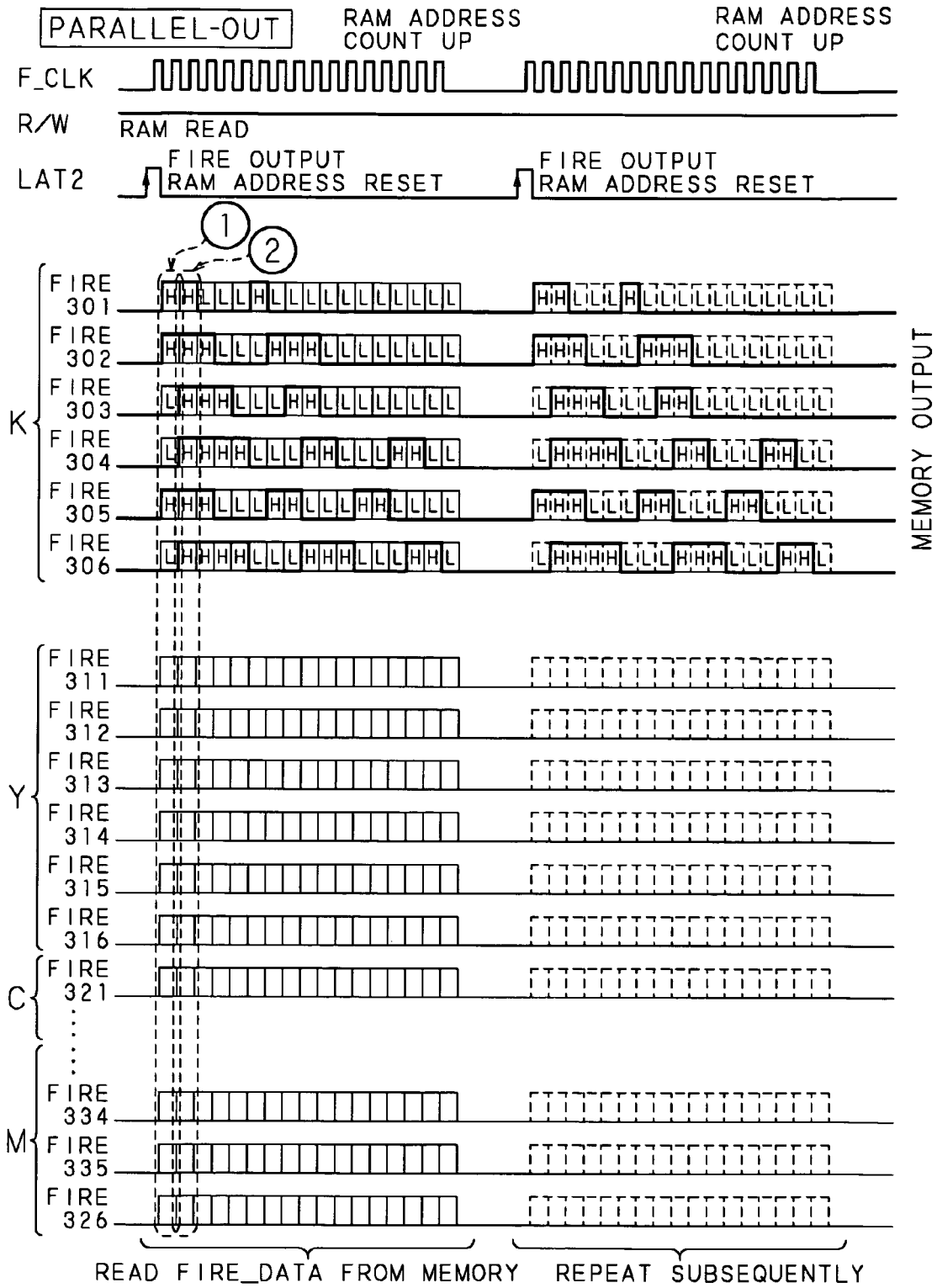

At this time, the signal R/W is set in a state writable in the memories 235C, and the address counter 235B is cleared by the clear signal CLR; therefore the parallel signals outputted from the second latching circuit 235D are stored in the beginning areas of the respective memories 235C (the longitudinal one line at the left end of FIG. 11B).

Similarly, the second group consisting of the second bit in the recording waveform signals FIRE 301-336 of respective groups (K, Y, C, M) is parallel developed to the second latching circuit 235D by the second serial-parallel converting circuit 235A, the address counter 235B is counted up by the clock signal F_CLK, and it is stored in the respective memories 235C successive to the first bit (the second line from the left end of FIG. 11B). Thus, respective bits of the recording waveform signals FIRE 301-336 of respective groups (K, Y, C, M) are arranged in order in respective memories 235C in a horizontal line in FIG. 11B and the recording waveform signals FIRE 301-336 respectively having different pulse numbers and different pulse widths are formed in the respective memories 235C.

At printing (recording), the signal R/W is set in a state writable in the memories 235C, and the address counter 235B is cleared by the clear signal CLR. The recording waveform signals FIRE 301-336 formed in the respective memories 235C are respectively downloaded from respective beginning areas according to the clock signal F_CLK, and outputted to the respective selectors 233. The six kinds of the recording waveform signals, FIRE 301-306, FIRE 311-316, FIRE 321-326 and FIRE 331-336, for each group (K, Y, C, M) are respectively set in the respective selectors 233. The recording waveform signals FIRE 301-336 are repeatedly outputted by the clear signals CLR for one dot recording cycle.

On the other hand, the drive signals SIN0-2 corresponding to each nozzle (actuator) are downloaded from the image memory 25 by the gate array 214, and transferred serially to the head driver 221. The drive signals are parallel developed by the first serial-parallel converting circuit 231 and outputted to the selectors 233 as 3 bits selection signals from the first latching circuit 232 respectively. Based on the content of the 3 bits selection signal, one corresponding recording waveform signal is selected from the six kinds of the recording waveform signals, FIRE 301-306, FIRE 311-316, FIRE 321-326 and FIRE 331-336 which are inputted in the respective selectors 233 and outputted to the drivers 234. By this, the recording head 1 ejects ink droplets having the volume of liquid drops and the number of liquid drops which were set by the recording waveform signals In one recording mode, the six kinds of the recording waveform signals, FIRE 301-306, FIRE 311-316, FIRE 321-326 and FIRE 331-336 are held in the respective memories 235C, and outputted repeatedly by setting the interval of the clear signals CLR as a recording cycle of one dot. The cycle of the latching signal LAT1 inputted in the first latching circuit 232 may be no problem so far as it is applied to the above-mentioned cycle.

The recording operation can be carried out at a different recording mode by storing the serial signal FIRE-DATA for generating many kinds of the recording waveform signals in ROM 12 and changing the kinds of the serial signal FIRE-DATA transferred to the head driver 221 based on the recording mode switching signal which are transferred from the host computer 26. Further, when the serial signal FIRE-DATA is transferred from the host computer 26 to RAM13 or the image memory 25, the recording mode can be switched by changing the kind of the serial signal FIRE-DATA transferred from the host computer 26.

In the ink jet recording apparatus of color recording, the recording waveform signals are not changed for each ink and the recording waveform signals common for several ink may be used. Further, it can be also configured so that the second serial-parallel converting circuit 235A and the second latching circuit 235D are provided for respective recording heads of respective ink and the serial signal is serially transferred from the gate array 214 for each recording head.

Further, when a lot of image data which are nearly simultaneously ejected are transferred from the host computer 26, it can be also configured so that the serial signal FIRE_DATA which is set so that a lot of drive pulses are not duplicated are transmitted together with image data from the host computer 26 in order to prevent power peak or in order to prevent cross talk, and stored in RAM 13 or the image memory 25.

Further, it can be also configured so that the serial signal FIRE_DATA outputted from the gate array 214 is corrected in accordance with environmental condition such as temperature.

The ink jet recording apparatus was illustrated in the third embodiment, but it is not limited to that and can be also applied to recording apparatuses using an impact type recording head, a thermal type recording head and the like. Further, it can be also applied to not only the tone control of recording density (printing density), but also historical control, namely to select the recording waveform depending on the presence or absence of previous or next recording signals considering vibration remaining in an impact element of the impact type recording head, and to select the recording waveform depending on the presence or absence of previous or next recording signals considering heat remaining in a heater element of the thermal recording head.

According to the third embodiment, the serial signals serially transmitted are downloaded in order by the memory device based on the clock signal transmitted from the signal transmission circuit and stored in order in a location where address is assigned; therefore a plurality of kinds of parallel recording waveform signals for one recording cycle are generated.

According to the third embodiment, the serial signal ("H" level or "L" level) is downloaded in order by the serial-parallel converting circuit of the recording apparatus, based on the respective clock pulses (for example, the timing of the rising edge of the respective clock pulses) in the clock signal and converted to parallel signals corresponding to the numbers of kinds of recording waveform signals. Then, since the parallel signals are stored in order in a location which is assigned by the address counter, the plurality of kinds of recording waveform signals for one recording cycle are recorded in the memory.

According to the third embodiment, since the plurality of kinds of recording waveform signals for one recording cycle are designed to be changed by switching of the recording mode, the optimum recording waveform signal corresponding to the recording mode can be used for each recording mode. Further, in case of the same recording mode, since the plurality of kinds of recording waveform signals for one recording cycle recorded are repeatedly outputted at a predetermined cycle, the serial signal is not required to be serially outputted repeatedly from the signal transmission circuit.

According to the third embodiment, a plurality of actuators are divided into a plurality of groups carrying out recording with the different kind of recording materials (for example, color ink) and the serial signal serially transmitted contains serially the information on the recording waveform signals corresponding to respective groups; therefore they are stored in order in a location where address is assigned and a plurality of kinds of the parallel recording waveform signals for one recording cycle are generated for each kind of recording materials.

According to the third embodiment, the number of signal lines for the serial signal transmitted through the flexible cable is reduced.

According to the third embodiment, it is possible to minutely control the drive for each actuator and the ejected quantity of ink droplets can be easily controlled.

As this description may be embodied in several forms without departing from the spirit of essential characteristics thereof, the present embodiments are therefore illustrative and not restrictive, since the scope is defined by the appended claims rather than by the description preceding them, and all changes that fall within metes and bounds of the claims, or equivalence of such metes and bounds thereof are therefore intended to be embraced by the claims.

The invention claimed is:

1. A recording apparatus comprising:

a recording head that performs dot recording and has a plurality of actuators;

a drive circuit that outputs drive pulses to the plurality of actuators of the recording head; and a signal transmission circuit that serially transmits, to the drive circuit, a serial signal for generating a plurality of recording waveform signals for the dot recording, and selection data on a selection signal for each actuator, for selecting a predetermined recording waveform signal from the plurality of recording waveform signals, wherein the drive circuit includes:

a serial-parallel converting circuit that parallely converts the serial signal transmitted from the signal transmission circuit so as to generate the plurality of recording waveform signals; and a selecting unit comprising a plurality of selectors connected to the serial-parallel converting circuit through a plurality of signal lines, respectively, the plurality of signal lines corresponding to the plurality of recording waveform signals, respectively, wherein each of the plurality of selectors selects, based on the selection signal, a predetermined recording waveform signal from the plurality of the recording waveform signals independently of each other selector, and the drive circuit outputs the recording waveform signal selected by each selector, and wherein the serial-parallel converting circuit parallely converts the serial signal corresponding to each of clock pulses of a clock signal transmitted from the signal transmission circuit, into parallel signals corresponding to the plurality of recording waveform signals, and the serial-parallel converting circuit outputs the plurality of parallel recording waveform signals based on a latching signal outputted from the signal transmission circuit, and wherein each of the recording waveform signals contains one or more drive pulses, and the serial signal contains a state of the one or more drive pulses of each of the recording waveform signals, in serial, for each group of a constant number of clock pulses, and wherein in the serial signal, the plurality of the recording waveform signals that are divided based on the clock signal along a time series, are aligned along the time senses.

2. The recording apparatus according to claim 1, wherein the serial-parallel converting circuit sequentially downloads and parallely converts the serial signal based on a clock signal transmitted from the signal transmission circuit.

3. The recording apparatus according to claim 1, wherein the latching signal is outputted at a predetermined cycle with a group of a constant number of clock pulses interposed between the cycles, and the serial-parallel converting circuit changes the converted parallel signals based on the serial signal corresponding to the next group of the clock pulses.

4. The recording apparatus according to claim 1, wherein the serial-parallel converting circuit outputs the recording waveform signals repeatedly at a constant cycle.

5. The recording apparatus according to claim 1, wherein the recording head and the drive circuit are mounted on a carriage capable of moving along a recording medium, the signal transmission circuit is provided on a main body of the apparatus that includes the carriage, and the selection data and the serial signal are transmitted to the drive circuit through a flexible cable provided between the main body of the apparatus and the carriage.

6. The recording apparatus according to claim 1, wherein each of the actuators of the recording head ejects ink droplets by increasing and decreasing the volume of an ink chambers storing ink based on the drive pulse of the selected recording waveform signal.

* * * * *